US006575092B1

(12) United States Patent
Harenbrock et al.

(10) Patent No.: US 6,575,092 B1
(45) Date of Patent: Jun. 10, 2003

(54) COLOR SUPPLY DEVICE FOR A COLOR DUCTOR

(75) Inventors: Marcus Klaus Harenbrock, Würzburg (DE); Wolfgang Otto Reder, Veitshöchheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/868,638

(22) PCT Filed: Dec. 21, 1999

(86) PCT No.: PCT/DE99/04046

§ 371 (c)(1),
(2), (4) Date: Jun. 28, 2001

(87) PCT Pub. No.: WO00/38922

PCT Pub. Date: Jul. 6, 2000

(30) Foreign Application Priority Data

Dec. 29, 1998 (DE) ..... 198 60 641

(51) Int. Cl.[7] ..... B41F 31/02

(52) U.S. Cl. ..... 101/364; 101/350.1; 101/350.2; 101/365; 101/366

(58) Field of Search ..... 101/348, 349.1, 101/350.1, 350.2, 350.5, 364, 365, 366, 367

(56) References Cited

U.S. PATENT DOCUMENTS

| | | | | | |
|---|---|---|---|---|---|
| 2,081,906 | A | | 6/1937 | Ball | 101/366 |
| 2,377,482 | A | | 6/1945 | Crafts | 101/157 |
| 3,134,326 | A | | 5/1964 | Davis | 101/366 |
| 3,298,305 | A | * | 1/1967 | Noon | 101/366 |
| 4,085,672 | A | * | 4/1978 | Grosart | 101/169 |
| 4,281,597 | A | | 8/1981 | Dressler | 101/365 |
| 4,332,196 | A | * | 6/1982 | Braun | 101/365 |
| 4,357,871 | A | * | 11/1982 | Kobler et al. | 101/350.1 |
| 4,461,209 | A | | 7/1984 | Washchynsky et al. | 101/219 |
| 4,559,871 | A | * | 12/1985 | Kutzner et al. | 101/207 |
| 4,711,175 | A | * | 12/1987 | Hummel et al. | 101/365 |
| 5,125,341 | A | * | 6/1992 | Yaeso | 101/367 |
| 5,167,188 | A | * | 12/1992 | Lindblom | 101/364 |

FOREIGN PATENT DOCUMENTS

| | | |
|---|---|---|
| CH | 532 429 | 2/1973 |
| DE | 244561 | 3/1912 |
| DE | 925 942 | 4/1955 |
| DE | 1 100 041 | 2/1961 |
| DE | 2 043 078 | 3/1972 |
| DE | 28 16 881 | 10/1978 |
| EP | 0 116 893 | 2/1984 |
| GB | 691047 | 5/1953 |

* cited by examiner

*Primary Examiner*—Andrew H. Hirshfeld
*Assistant Examiner*—Jill E Culler
(74) *Attorney, Agent, or Firm*—Jones, Tullar & Cooper, P.C.

(57) ABSTRACT

A color ink supply device for an ink ductor in a rotary printing press achieves an even color distribution on the ink ductor. A plurality of ink supply devices are arranged axially along the ink ductor. Each ink supply device includes a main chamber and may also include a pre-chamber. A doctor blade device may also be utilized.

9 Claims, 1 Drawing Sheet

COLOR SUPPLY DEVICE FOR A COLOR DUCTOR

FIELD OF THE INVENTION

The present invention relates to an ink unit with an ink supply device for an ink ductor. A plurality of ink feed devices are arranged next to each other in an ink supply strip. Each ink feed device has an ink feed line which supplies ink to a chamber located at the ink ductor.

DESCRIPTION OF THE PRIOR ART

A device for applying ink to a rotatable cylinder of a rotary printing press is known from DE 28 16 881 A1. Ink is supplied by a pump to a conduit via a bore, which bore branches into two flow paths and meets the surface of the rotatable ink roller in the radial direction. A plurality of pumps are arranged next to each other.

U.S. Pat. No. 2,377,482 A describes an ink applicator strip for a forme cylinder of a rotogravure press. This ink applicator strip has a plurality of slit-shaped nozzles, wherein adjoining nozzles are connected in the area of their outlet opening.

U.S. Pat. No. 4,461,209 A shows an ink supply device for a forme cylinder, having an ink supply strip. This ink supply has several main chambers, which are connected at their ends by overflow openings.

SUMMARY OF THE INVENTION

The object of the present invention is directed to providing an ink unit with an ink supply device for an ink ductor.

In accordance with the present invention, this object is attained by providing an ink supply device that has a plurality of ink feed devices. These ink feed devices are arranged next to each other in an ink supply strip. Each ink feed device has an ink feed line and at least one main chamber for each ink color zone of the ink ductor. The ends of the main chambers terminate at the ink ductor.

The advantages which can be obtained by the present invention primarily consist in that an even ink distribution for each ink pump unit and color zone is achieved on the surface of the ink ductor.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENTS

Figure 2:
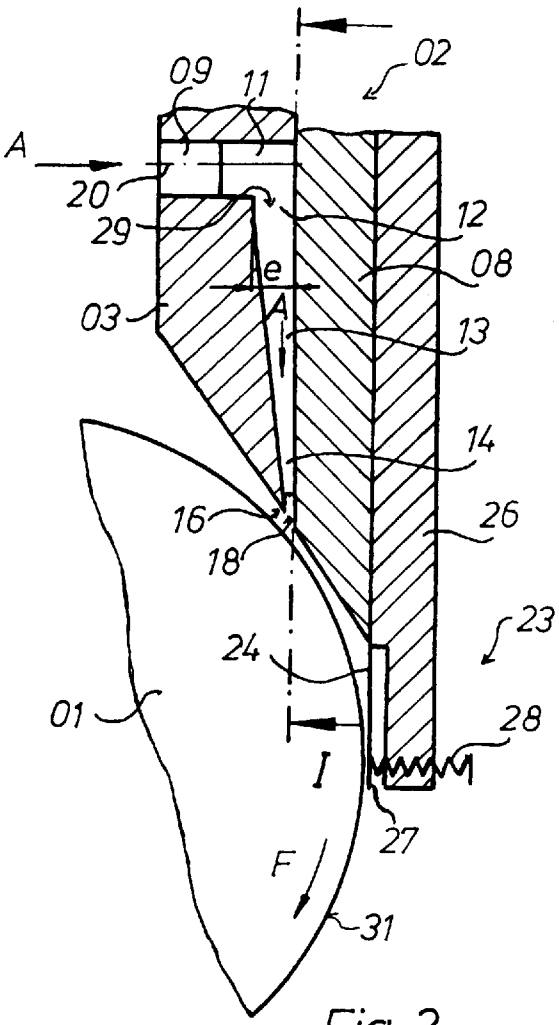

An ink supply device 02, fastened on the press frame, is arranged in cooperation with an ink ductor 01 of an ink unit, which ink unit is not specifically represented, of a rotary printing press. The ink supply device 02 extends in length at least for one-quarter of the width of the ink ductor 01 in its axial direction and consists at least of an ink supply strip 03 with a number, for example six to eight, of ink feeds 05, 06, 07 for color zones arranged next to each other, as well as of a closing strip 08 of equal length arranged on the ink supply strip 03. Each one of the ink feeds 05 to 07 located on the ink supply strip 03 has an ink feed line 09 coming from a controllable ink pump, not represented, which ink feed line 09 is adjoined, in the flow direction A of the ink, by a pre-chamber 11, which, in turn, leads to an inlet 12 of a main chamber 13. The main chamber 13 is shaped into a slit-shaped nozzle 16 at its discharge end 14 close to the ink ductor 01. The main chambers 13 are separated from each other by strips 17.

Figure 1:
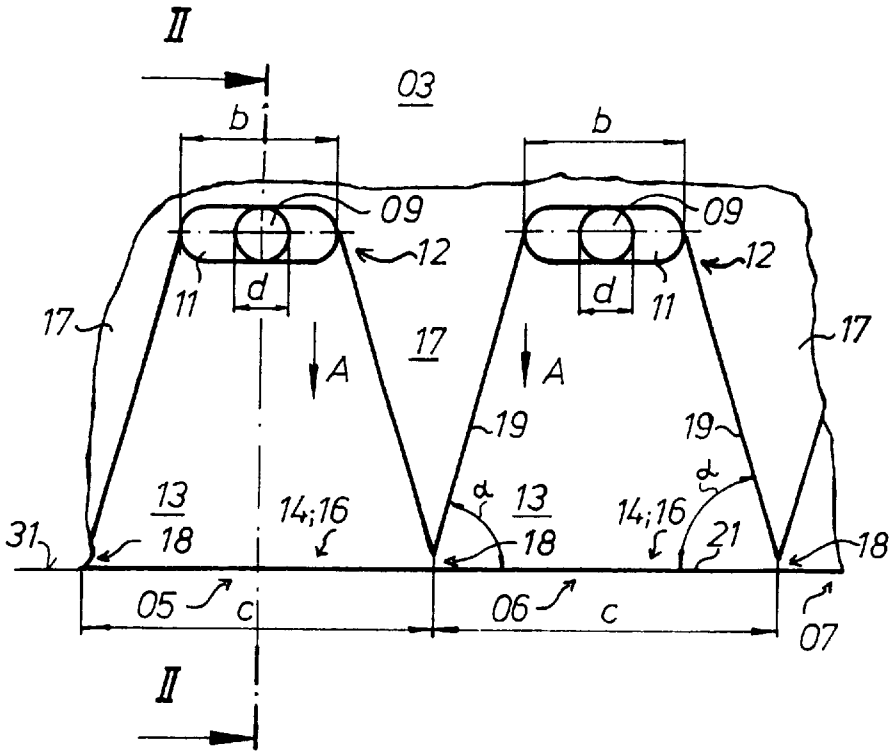
FIG. 1, a longitudinal section through an ink supply strip with pre-chambers and main chambers taken along line I—I of FIG. 2 in a partial representation, and in FIG. 2 a longitudinal section through an ink supply strip with pre-chambers and main chambers taken along line II—II of FIG. 1 and with the additional representation of an ink ductor.

The pre-chamber 11 extends horizontally and at right angles to a longitudinal axis 20 of the bore or ink feed line 09 as seen in FIG. 2, and has a width "b", for example "b"=40 mm, which corresponds at least to twice the width or diameter "d", for example "d"=10 mm, of the ink feed line 09. At its inlet 12, the adjoining main chamber 13 is of the same width "b" and then widens, viewed in the flow direction A, to a width "c" at its end 14, for example "c"=52 mm. The width of the strips 17, which, as shown in FIG. 1, are embodied in a wedge shape, decreases by the same amount.

With increasing widening "b", "c" of the main chamber 13, its thickness "e" is reduced, viewed in the flow direction A, for example "e"=1 mm as seen in FIG. 2.

The ink can also be supplied in a "clocked" or "pulsed" manner to the ink supply device 02 from the controllable ink pump, which is not specifically represented.

The ink feed line, pre-chamber and main chamber 09, 11, 13, respectively in the ink supply strip 03 are easily accessible, for example for cleaning purposes, and are bordered, or closed, by the closing strip 08.

In accordance with a variation of the above-described preferred embodiment, each main chamber 13 has an overflow opening 18 for ink to the adjoining main chamber 13 on its discharge end 14 near the strip. This overflow opening 18 can be provided by shortening the strips 17 at the end 14 of the main chamber 13, as shown in FIG. 1.

The overflow opening 18 has a height "I", for example "I"=2 mm, and a depth "y", for example "y"=0.6 mm, at the front, and a depth "x", for example "x"=0.5 mm, at the end near the ink ductor 01, and therefore a cross section of "y"·"I"=1.2 $mm^2$.

The ratio of the outlet cross section b"·"e" of the pre-chamber 11 to an outlet cross section "c"·"x" at the discharge end 14 of the slit-shaped nozzle 16 is greater than 1 and less than 2, preferably $(b \cdot e)/(c \cdot x)=1.4$ to 1.6.

The ratio of the height "I" of the overflow opening 18 to a height L, for example L=60 mm, of the main chamber 13 is greater than 0.01 and less than 0.03, preferably I/L=0.02.

The ink supply device 02 is preferably arranged in such a way in respect to the ink ductor 01, that each of the main chambers 13 extends approximately in the vertical direction, and that the slit-shaped nozzles 16 at the discharge end 14 each point in an approximately tangential direction toward the ink ductor 01. The working direction of rotation F of the ink ductor 01 extends in the same direction with the flow direction A of the ink.

In accordance with another variation of the preferred embodiment of the ink supply strip 03, a pre-chamber can have a width which is greater in comparison with the above-described first embodiment that is shown in FIG. 1, for example up to five times the diameter "d" of the ink feed line 09. Thus, an inlet 12 of a main chamber 13 is wider, and strips 17 arranged between the main chambers 13 are narrower, in comparison to those in the first preferred embodiment. The prerequisite here is that an angle α formed at the discharge end 14 of the main chamber 13 between a flank 19 of the main chamber 13 and a horizontal line 21 be less than 90°.

The ink supply device of the present invention functions as follows: because of the arrangement of the pre-chamber 11, the ink flow from ink feed line 09 is already broadly distributed prior to it flowing into the main chamber 13. The broad distribution of the ink is initially obtained because a cross-sectional area of the ink feed line 09 leading to the pre-chamber 11 is greater than a cross-sectional surface "e"·"b" of an outlet 29 of the pre-chamber 11 into the main chamber 13. Because of this, the pre-chamber 11 is always filled with ink and is therefore used as an ink reservoir. An even ink distribution in each color zone on the ink ductor 01 thus takes place. This means that an even ink film forms over each of the color zones on the surface 31 of the ink ductor 01. The overflow openings 18, located at the discharge end 14 of the main chamber 13, through which a possible compensation of the amounts of ink can occur, are therefore advantageous for providing an even ink distribution over the width of the ink metering roller 01.

In accordance with a further preferred embodiment of the present invention, a doctor blade arrangement 23 is assigned to the ink supply device 02 which doctor blade arrangement 23 is located, in the working direction of rotation F of the ink ductor 01, after the ink supply device 02, as seen in FIG. 2. A doctor blade 24 can be placed at a positive contact angle against the ink ductor 01. Positive contact angle of the doctor blade 24 against the ink ductor 01 means that the doctor blade 24 rests against the surface 31, or is slight spaced apart from it, while pointing with the front face 27 in the working direction of rotation F.

The doctor blade 24 extends approximately tangentially with respect to the ink ductor 01. The doctor blade 24 is arranged so that, for example, it can be clamped in place between the closing strip 08 and a support strip 26 located on the closing strip 08. In the area of its front edge 27, the doctor blade 24 can be adjustable by means of arresting devices, for example screws 28.

While preferred embodiments of a color supply device for a color ductor of a rotary printing press in accordance with the present invention have been set forth fully and completely hereinabove, it will be apparent to one of skill in the art that a number of changes in, for example, the overall size of the ductor roller, the type of rotary press the ductor is used with, and the like could be made without departing from the true spirit and scope of the present invention which is accordingly to be limited only by the following claims.

What is claimed is:

1. An ink unit with an ink supply device for an ink ductor comprising:

an ink supply strip arranged adjacent the ink ductor;

a plurality of ink feed devices arranged next to each other in said ink supply strip and extending axially along the ink ductor;

a separate ink feed line for each one of said plurality of ink feed devices;

at least one main chamber for each one of said plurality of ink feed devices, each said main chamber having an ink inlet and an ink discharge end, each said ink discharge end terminating at the ink ductor in a slit-shaped nozzle, each said slit-shaped nozzle extending in a tangential direction to the ink ductor, each said main chamber having a width generally transverse to a direction of ink flow in said main chamber from said ink inlet to said ink discharge end and extending axially with respect to the ink ductor and having a thickness generally transverse to said ink supply strip, each said main chamber width increasing and each said main chamber thickness decreasing in said direction of ink flow in each said main chamber; and a pre-chamber located in said direction of ink flow in the ink supply device after said ink feed line and before said ink inlet to each said main chamber, each said pre-chamber having a width extending axially with respect to the ink ductor and corresponding to at least twice a diameter of said ink feed line.

2. The ink unit of claim 1 wherein said ink supply strip has at least one closing strip, said closing strip covering each said pre-chamber, and each said main chamber.

3. The ink unit of claim 1 further including a doctor blade device located after, in a direction of rotation of the ink ductor, said ink supply device.

4. The ink unit of claim 3 wherein said doctor blade device includes a doctor blade, said doctor blade being engageable with the ink ductor at a positive angle.

5. The ink unit of claim 4 further including a support strip clamping said doctor blade in place on said doctor blade device.

6. The ink unit of claim 4 wherein said doctor blade has a front edge and further wherein said front edge is displaceable in a radial direction of the ink ductor.

7. The ink unit of claim 1 wherein said ink supply device has a length, said length being at least one quarter of a width of the ink ductor.

8. The ink unit of claim 1 further wherein each said ink feed line has a first cross-sectional area and further wherein each said pre-chamber has a second cross-sectional area, each said first cross-sectional area being greater than each said second cross-sectional area.

9. The ink unit of claim 1 further including ink overflow openings located at said ink discharge end of each said main chamber.

* * * * *